US010933509B2

(12) United States Patent
Spampinato et al.

(10) Patent No.: US 10,933,509 B2
(45) Date of Patent: Mar. 2, 2021

(54) ABRASIVE MACHINING

(71) Applicant: ROLLS-ROYCE plc, London (GB)

(72) Inventors: Alessio Spampinato, Nottingham (GB); Dragos A. Axinte, Nottingham (GB); Donka Novovic, Birmingham (GB); Paul Butler-Smith, Nottingham (GB)

(73) Assignee: Rolls-Royce plc, London ( * ) Notice: Subject to any disclaimer, the term of this patent is extended or adjusted under 35 U.S.C. 154(b) by 334 days.

(21) Appl. No.: 16/002,511

(22) Filed: Jun. 7, 2018

(65) Prior Publication Data

US 2018/0361540 A1 Dec. 20, 2018

(30) Foreign Application Priority Data

Jun. 16, 2017 (GB) ..... 1709626

(51) Int. Cl.

| | |
|---|---|
| ***B24D 5/06*** | (2006.01) |
| ***B24D 18/00*** | (2006.01) |
| ***B24B 53/12*** | (2006.01) |
| ***B24B 19/00*** | (2006.01) |

(52) U.S. Cl.

CPC ..... *B24D 5/066* (2013.01); *B24B 19/009* (2013.01); *B24B 53/12* (2013.01); *B24D 5/06* (2013.01); *B24D 18/009* (2013.01)

(58) Field of Classification Search

CPC ..... B24D 5/066; B24D 5/06; B24D 18/009; B24B 53/12; B24B 18/009

See application file for complete search history.

(56) References Cited

U.S. PATENT DOCUMENTS

| | | | | |
|---|---|---|---|---|
| 2,104,594 A | | 1/1938 | Rickard | |
| 2,219,398 A | * | 10/1940 | Rickard | B24D 5/06 451/543 |
| 3,633,637 A | * | 1/1972 | Kolesh | B23D 65/00 83/840 |
| 3,678,915 A | | 7/1972 | Kikuchi | |
| 3,827,422 A | * | 8/1974 | Wise | B24B 53/14 125/37 |
| 4,206,953 A | | 6/1980 | Diehl et al. | |
| 4,289,110 A | | 9/1981 | Junker | |
| 4,683,679 A | | 8/1987 | Salmon | |

(Continued)

FOREIGN PATENT DOCUMENTS

| | | |
|---|---|---|
| CA | 2254189 | 11/1998 |
| CN | 214080 | 8/1993 |

(Continued)

OTHER PUBLICATIONS

"Grinding Wheels, Solutions for Industry," Master Abrasives Brochure, retrieved Jun. 5, 2018, www.master-abrasives.co.uk.

(Continued)

*Primary Examiner* — Dung Van Nguyen

(74) *Attorney, Agent, or Firm* — Barnes & Thornburg LLP

(57) ABSTRACT

A rotary abrasive machining tool (101) is shown. The tool comprises a hub (103) having plurality of axially-oriented radial slots in the outer circumference thereof, and plurality of abrasive segments each of which is located in a respective slot in the hub and which form an abrading surface (102). The abrasive segments comprise a tab for location in a slot in the hub, and an abrading edge defining a plurality of abrasive elements.

10 Claims, 12 Drawing Sheets

(56) References Cited

U.S. PATENT DOCUMENTS

| | | | | |
|---|---|---|---|---|
| 4,696,130 | A | 9/1987 | Belthle | |
| 4,730,596 | A | 3/1988 | Maack et al. | |
| 5,954,568 | A | 9/1999 | Wirz | |
| 8,495,942 | B2 * | 7/2013 | Rattunde | B23D 61/023 76/112 |
| 2007/0128986 | A1 | 6/2007 | Imai et al. | |
| 2011/0143641 | A1 | 6/2011 | Ramanath et al. | |
| 2013/0217315 | A1 * | 8/2013 | Wiand | B24D 5/12 451/541 |
| 2016/0271752 | A1 | 9/2016 | Axinte et al. | |

FOREIGN PATENT DOCUMENTS

| | | |
|---|---|---|
| CN | 2148640 | 12/1993 |
| CN | 104827401 | 8/2015 |
| DE | 3302478 | 7/1984 |
| DE | 3641937 | 6/1988 |
| DE | 3642731 | 6/1988 |
| DE | 3811784 | 7/1989 |
| DE | 3930184 | 3/1991 |
| EP | 2327511 | 6/2011 |
| GB | 119426 | 10/1918 |
| GB | 119765 | 10/1918 |
| GB | 519081 | 3/1940 |
| GB | 639897 | 7/1950 |
| GB | 811041 | 3/1959 |
| GB | 1159007 | 7/1969 |
| GB | 1233608 | 5/1971 |
| JP | S60104652 | 6/1985 |
| JP | H03149182 | 6/1991 |
| JP | H11245167 | 9/1999 |
| JP | 2000263440 | 9/2000 |
| JP | 2007196367 | 8/2007 |
| JP | 2012000770 | 1/2012 |
| TW | 201233499 | 8/2012 |

OTHER PUBLICATIONS

Great Britain search report dated Nov. 30, 2017, issued in GB Patent Application No. 1709626.4.

Extended EP Search Report completed by the EP Searching Authority dated Nov. 29, 2018 and issued in connection with EP Patent Application No. 18172852.8, 8 pages.

* cited by examiner

ABRASIVE MACHINING

CROSS-REFERENCE TO RELATED APPLICATIONS

This application is based upon and claims the benefit of priority from British Patent Application No. GB 1709626.4, filed on 16 Jun. 2017, the entire contents of which are incorporated by reference.

BACKGROUND

Technical Field

This disclosure relates to apparatus for rotary abrasive machining.

Description of the Related Art

The mechanisms of abrasive machining are known. One well-established abrasive machining technique is grinding, which is practiced with rotary abrasive machining tools known as grinding wheels. Grinding wheels are formed so as to have a tool profile that is the inverse of the desired profile of the component. As grinding wheels wear through use, there comes a point where the tool profile needs restoring, which is achieved using a process known as dressing. Rotary abrasive machining tools known as rotary dressers are used for this operation. It will therefore be understood that reference herein to a "rotary abrasive machining tool" therefore extends to grinding wheels, rotary dressing tools, and indeed to other forms of such machining tools.

Conventional rotary abrasive machining tools typically have abrasive surfaces with stochastic characteristics. In practice, this means that the abrasive elements in the surfaces have non-uniform spacing and varying degrees of protrusion from the surface. This can lead to poor extraction of material from the workpiece (the component being ground in the case of grinding, or the grinding wheel in the case of dressing) and thus loading of the rotary abrasive machining tool, reducing efficiency and increasing friction. Moreover, in profiled configurations, accelerated wear is experienced by the abrasive surface in critical profile regions.

One approach to controlling the characteristics of the abrasive surface is disclosed in US 2016/0271752 A, which is assigned to the present applicant. The rotary dressing tool disclosed therein comprises a plurality of co-axial discs, each one of which has an abrasive outer surface. However, this configuration does not facilitate the dressing of grinding wheels with profiles of complex geometry, such as required for grinding of fir tree roots of turbine blades for gas turbine engines, for example.

SUMMARY

The present disclosure is directed towards abrasive segments for rotary abrasive machining tools, methods of producing the abrasive segments, and rotary abrasive machining tools.

The abrasive segment comprises a tab for location in an axially-oriented radial slot on a rotary abrasive machining tool, and an abrading edge with a plurality of abrasive elements thereon.

The abrasive segment may be produced by a method comprising obtaining a blank of material for the abrasive segment, and machining the abrasive segment from a blank.

The rotary abrasive machining tool comprises a hub having plurality of axially-oriented radial slots on the outer circumference thereof, and a plurality of abrasive segments, each one of which has a tab which is located in a respective slot in the hub. The rotary abrasive machining tool may be used for rotary dressing of a grinding tool, or for grinding a component.

BRIEF DESCRIPTION OF THE DRAWINGS

The disclosure will now be described by way of example only with reference to the accompanying drawings, which are purely schematic and not to scale, and in which.

DETAILED DESCRIPTION

FIG. 1

Figure 1:
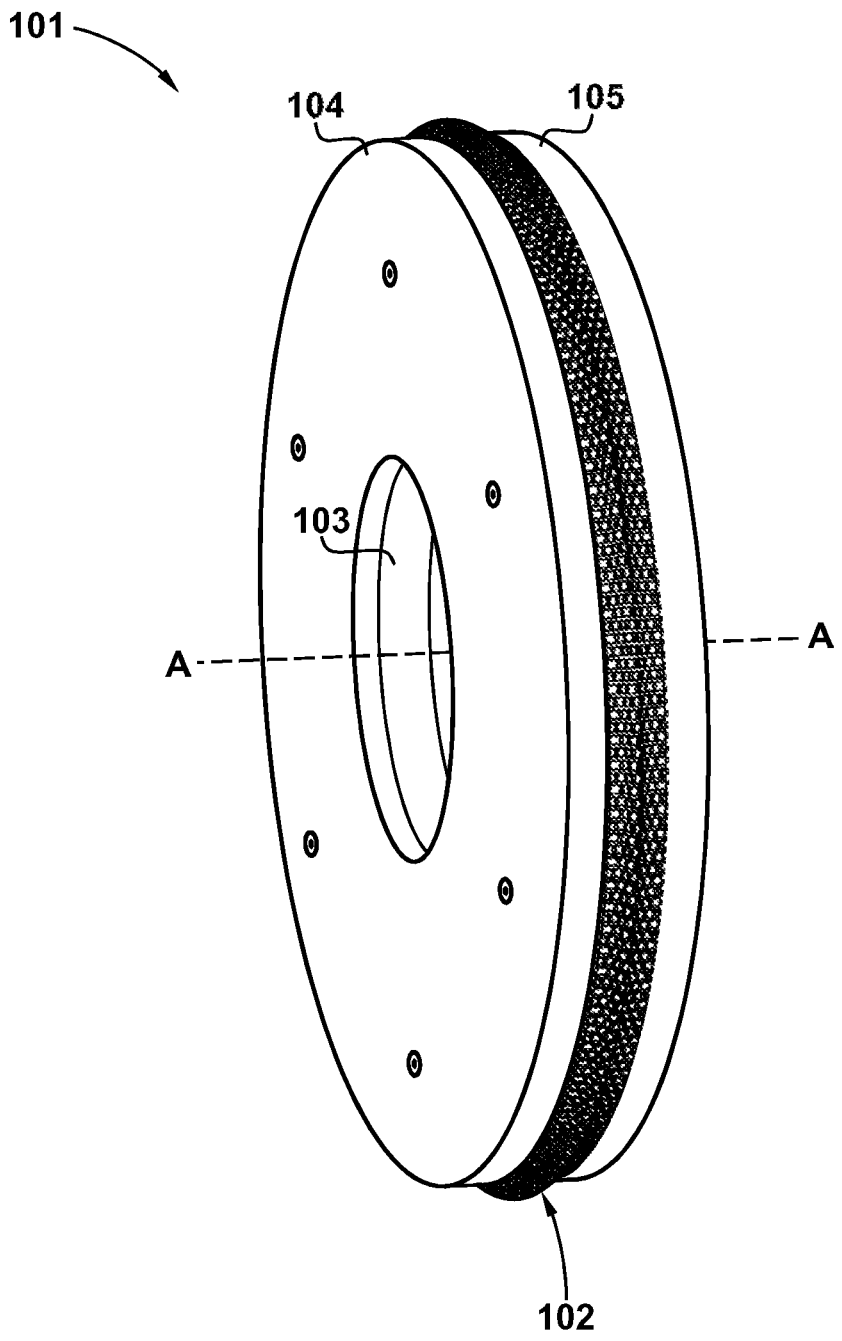
FIG. 1 shows a first embodiment of a rotary abrasive machining tool according to the present disclosure, in the form of a rotary dressing tool.

A first embodiment of a rotary abrasive machining tool according to an aspect of the present disclosure is shown in FIG. 1. In the illustrated embodiment, the rotary abrasive machining tool is a rotary dressing tool 101. As discussed previously however, it will be appreciated that the rotary abrasive machining tool could instead be configured as a grinding wheel or any other form of such a tool.

The rotary dressing tool 101 is generally of annular form for location upon a rotary dressing machine, and thus has a rotational axis A-A. The rotary dressing tool 101 comprises an abrading surface 102 concentric around on a hub 103, both of which are sandwiched between a first flange 104 and a second flange 105.

In use, the rotary dressing tool 101 is mounted upon a shaft of a rotary dresser machine whereupon it may facilitate dressing of a grinding wheel. In an alternative embodiment, in which the rotary dressing tool 101 is instead a grinding wheel, it would be mounted upon a shaft of a grinding machine to facilitate grinding of a component.

FIGS. 2 & 3

Figure 2:
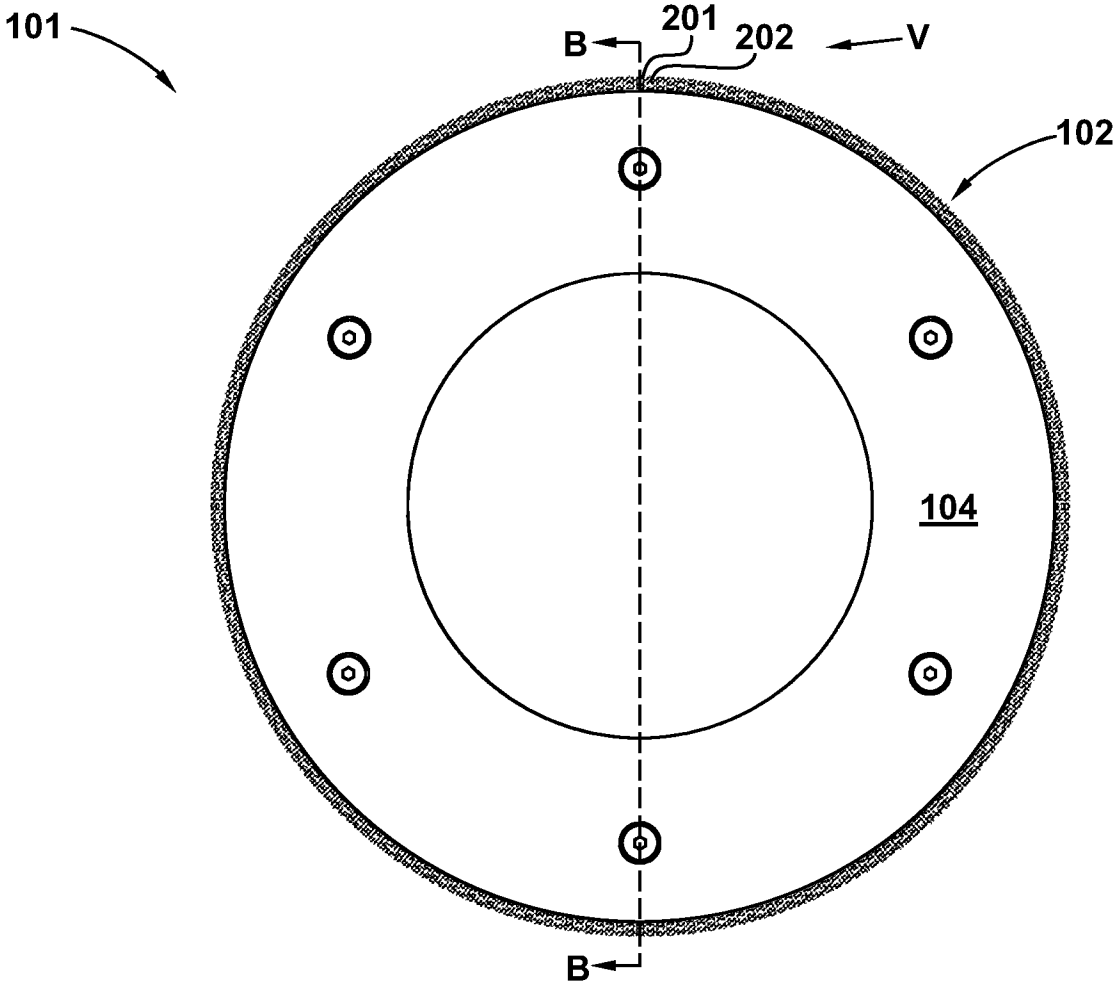
FIG. 2 shows the rotary dressing tool of FIG. 1 in plan view.
Figure 3:
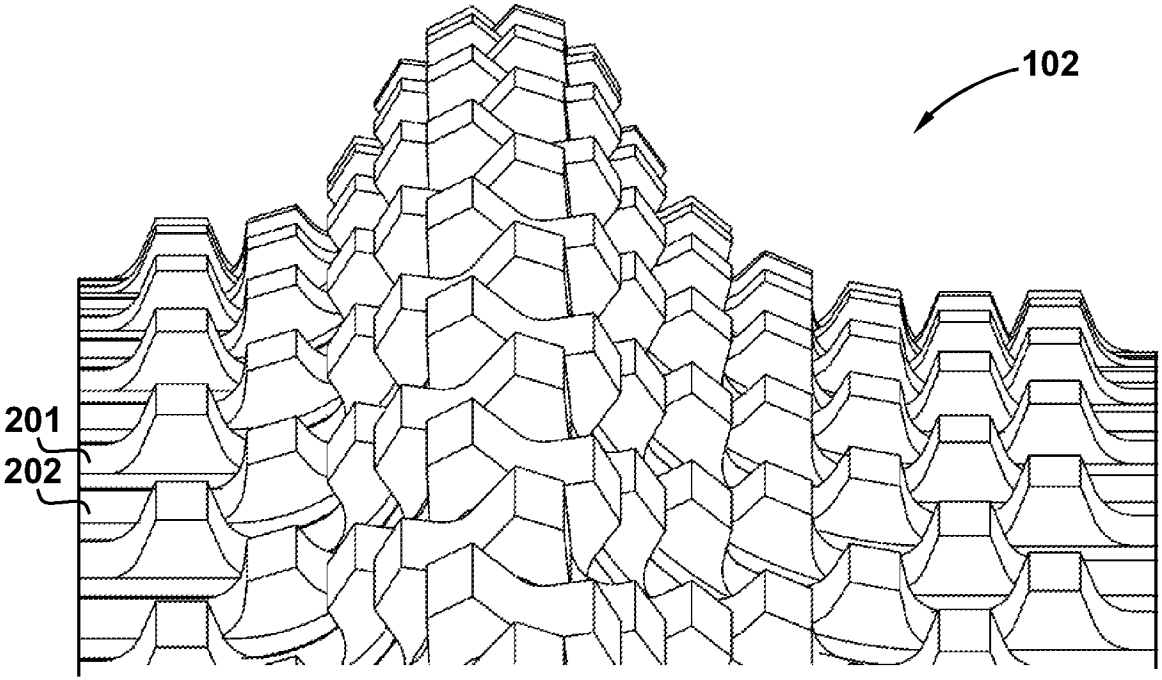
FIG. 3 shows a view of the abrading surface of the rotary dressing tool at V of FIG. 2.

The rotary dressing tool 101 is shown in plan view in FIG. 2, whilst FIG. 3 shows a view of the abrading surface 102 at V of FIG. 2.

As may be seen, the abrading surface 102 is provided by a plurality of abrasive segments, such as a first abrasive segment 201 and a second abrasive segment 202.

FIGS. 4A & 4B

Figure 4A:
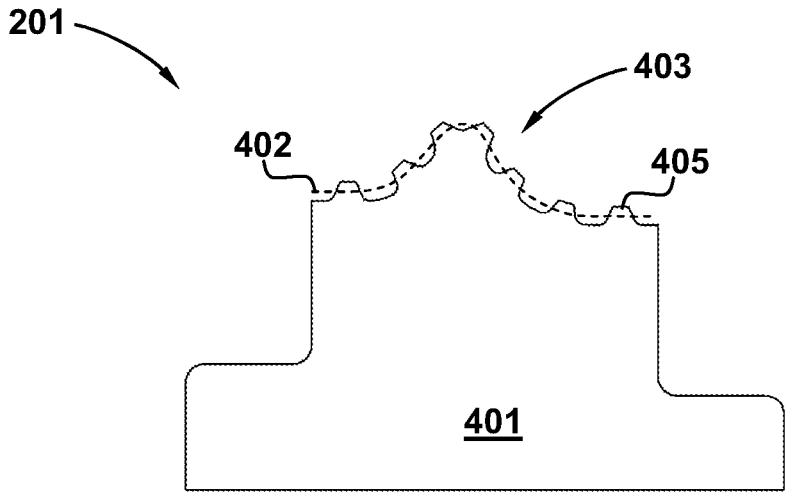
FIGS. 4A and 4B show, respectively, a first abrasive segment and a second abrasive segment.
Figure 4B:
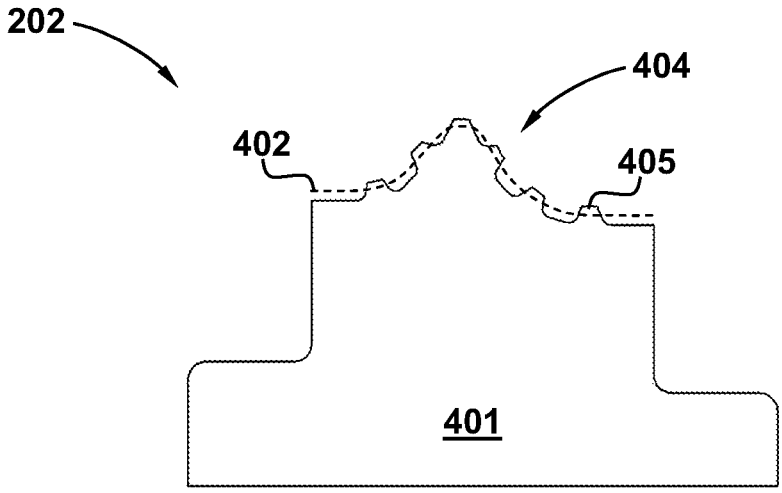

The first abrasive segment 201 is shown in isolation in FIG. 4A, and the second abrasive segment 202 is shown in isolation in FIG. 4B.

Each abrasive segment includes a tab 401 for mounting the abrasive segment in the hub 103. In the present example, the tab 401 is wider at its base than at its upper portion, the purpose of which will be described with reference to FIGS. 5 and 6.

Referring again to FIGS. 4A and 4B, each abrasive segment comprises a respective abrading edge 402 and 403. Both abrading edges share a profile 404, illustrated using a dashed line. However, as may be seen in the Figures, in the present embodiment the geometry of the abrading edges 402, 403 on each abrasive segment differs slightly. The abrading edge 402 defines a plurality of abrasive elements 405 that are offset in relation to the plurality of abrasive elements 405 defined by the abrading edge. The offset between the abrasive elements is, with respect to the rotary dressing tool 101, an axial offset. In this specific embodiment, the degree of offset is such that the abrasive elements on the abrading edge 402 line up with the gaps between the abrasive elements on the abrading edge 403, and vice versa.

The abrasive elements 405 defined by the abrading edges 402, 403 each have an abrading surface 406, each of which is parallel to the profile 404 at the location of the respective abrasive element 405.

Referring to FIG. 3, it may be seen that the abrading surface 102 of the present embodiment is formed by a plurality of alternating first and second abrasive segments 201 and 202. This, combined with the axially offset relationship between the abrasive elements 405, allows control of debris flow during dressing operations.

In alternative embodiments, the offset between the abrasive elements 405 on the different abrasive segments may be controlled so as to provide different patterns on the abrading surface 102, such as staggered or wave patterns. More than two types of abrasive segments may be combined depending upon the pattern required. The freedom afforded by the present disclosure to use different combinations of abrasive segments thus allows the abrading surface 102 to be configured in any desired manner. Indeed, embodiments are envisaged in which abrasive segments are provided that have different profiles, as well as or as an alternative to different distributions of abrading elements on the abrading edge.

In the present embodiment, each abrasive segment is composed of a diamond, such as polycrystalline diamond. In an alternative embodiment, the abrasive segments may be another form of diamond, or another substance such as cubic boron nitride.

The abrasive segments are in the present example produced by obtaining a blank of material for the abrasive segment, and then machining the abrasive segment from the blank. In a specific embodiment, the machining process comprises electrical discharge machining. Alternatively, pulsed laser ablation, water jet cutting, or any other suitable machining process may be used to machine the abrasive segments from the blanks.

By using a controlled machining process, many different shapes and sizes for the abrasive elements 405 may be chosen, which may be distributed in any desired manner along a defined profile. The geometry of the abrasive elements may be the same or different upon each abrasive segment 405. Further, the segments may be asymmetric so as to achieve different dressing characteristics in dependence upon rotation direction, for example.

The way in which the abrasive segments are mounted in the rotary dressing tool 101 will be described further with reference to FIGS. 5 to 7, whilst their configuration will be described further with reference to FIGS. 8A, 8B and 9.

FIGS. 5 & 6

Figure 5:
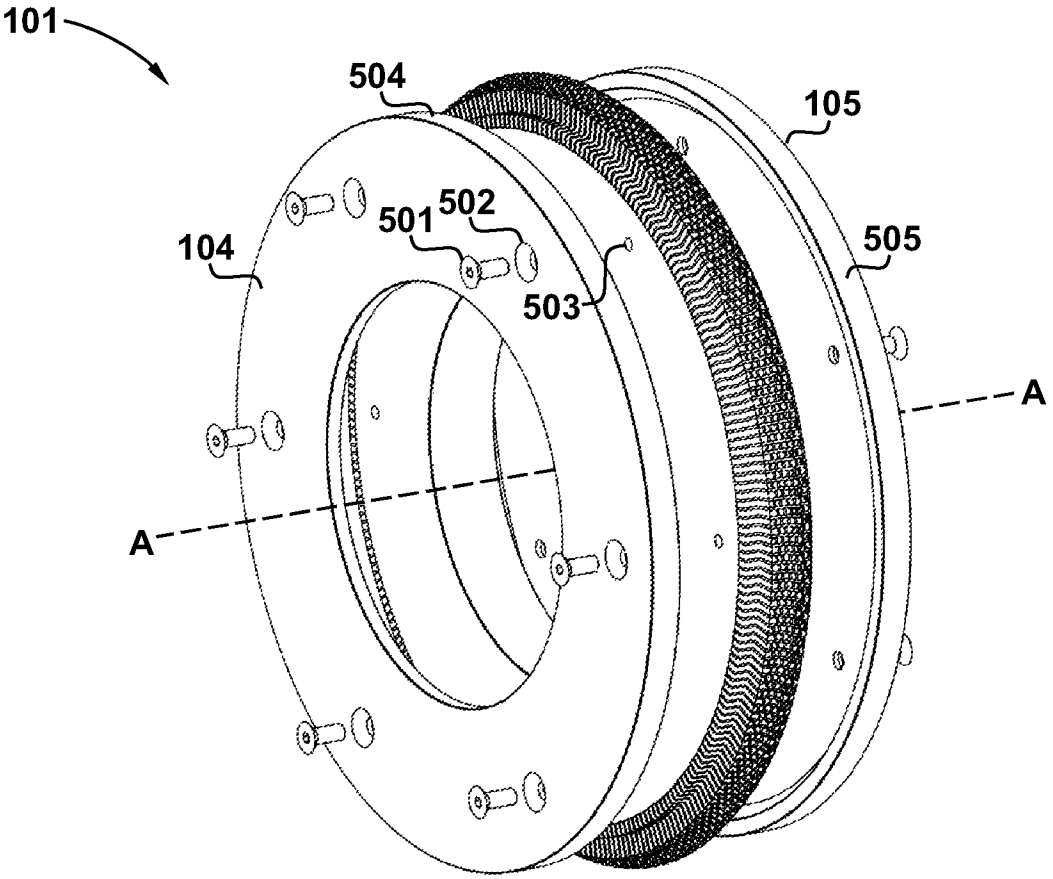
FIG. 5 shows the rotary dressing tool of FIG. 1 exploded along the axis A-A.
Figure 6:
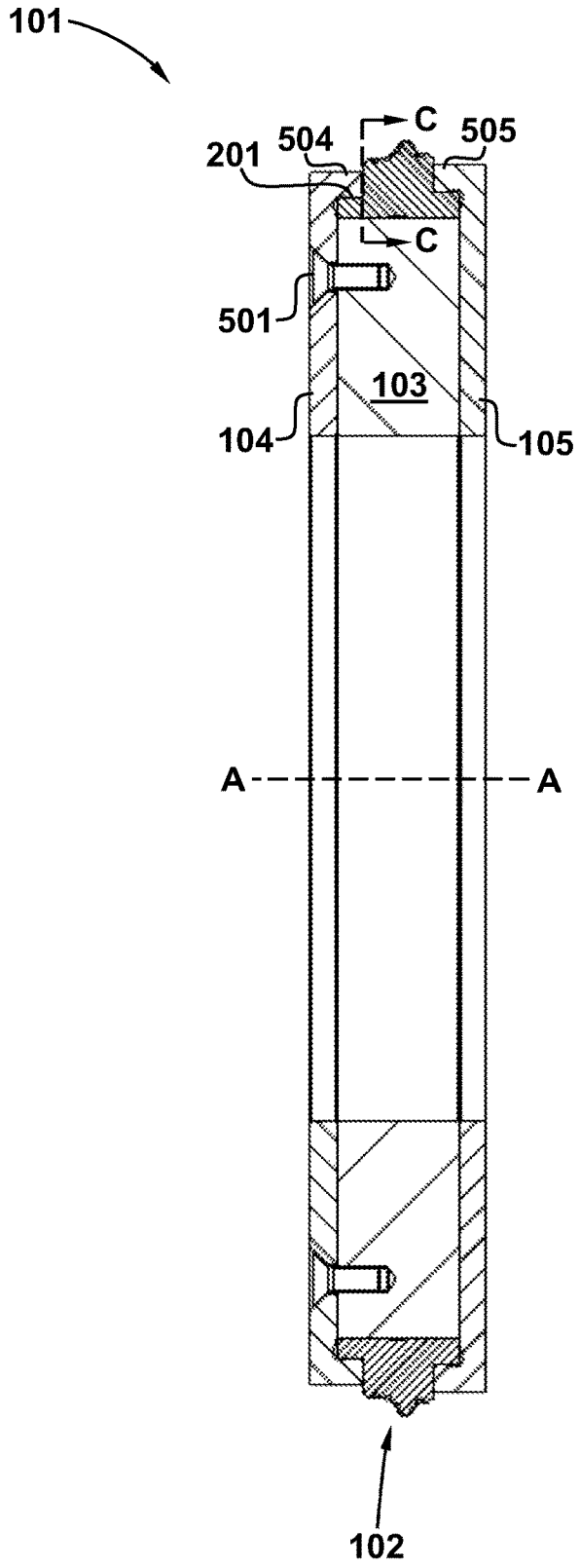
FIG. 6 shows a section of the rotary dressing tool along B-B of FIG. 2.

A view of the rotary dressing tool 101 exploded along the axis A-A is shown in FIG. 5, and a section of the rotary dressing tool 101 along B-B of FIG. 2 is shown in FIG. 6.

The flanges 104 and 105 are attached to the hub 103 by way of screws, such as screw 501. The screws pass through apertures in the flanges, such as aperture 502 in the flange 104, and are received in threaded holes in the hub 103, such as hole 503. The flanges 104 and 105 each include a respective circumferential rim 504 and 505.

Referring to FIGS. 4A and 4B, it will be noted that in the present example the tab 401 includes a base that is wider than its upper part. Referring again to FIGS. 5 and 6, when the flanges 104 and 105 are placed against the hub 103, the rims 504 and 505 co-operate with the wider base of the tab 401 to prevent radial movement of the abrasive segments.

FIGS. 7A & 7B

Figure 7A:
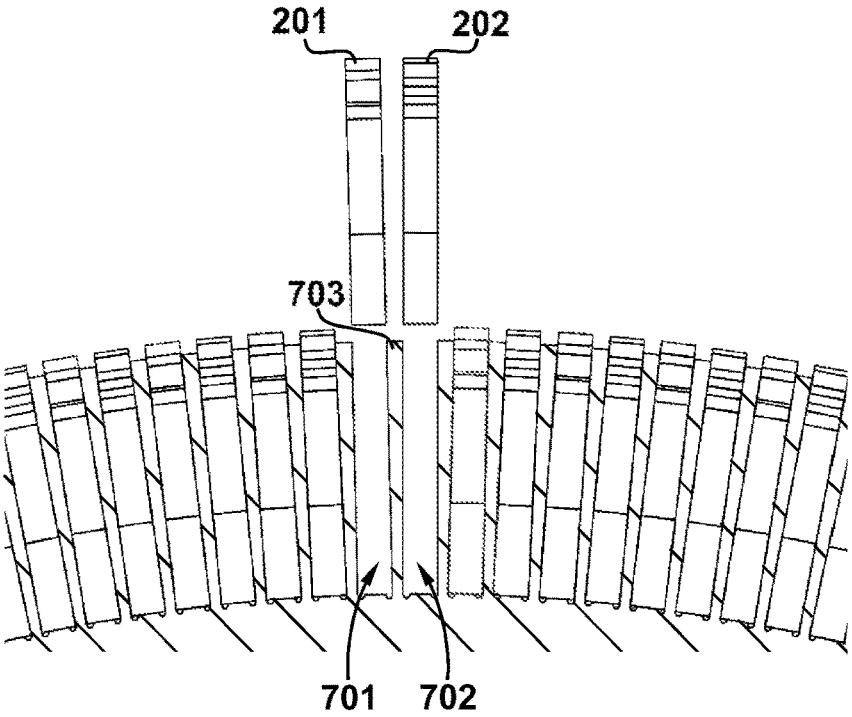
FIGS. 7A and 7B show two views of the positioning of the abrasive segments in slots in the hub of the rotary dressing tool.
Figure 7B:
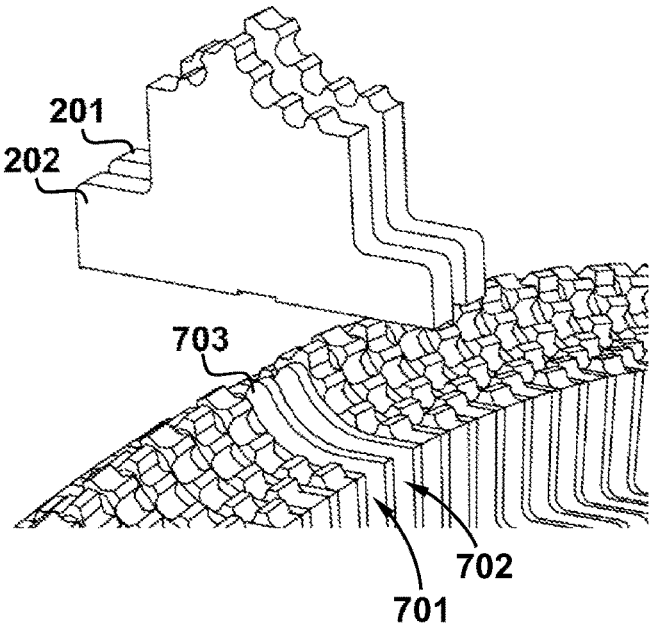

A partial section of the rotary dressing tool 101 along C-C of FIG. 6 is shown in FIG. 7A. A perspective view of the same region is shown in FIG. 7B. In both of these Figures, the abrasive segments 201 and 202 are shown in a removed position.

As described previously, the abrasive segments that form the abrading surface 102 are mounted in the hub 103. This is achieved in the present embodiment by the provision of a plurality slots in the outer circumference of hub, such as a first slot 701 and a second slot 702. The hub 103 may therefore be considered as having a plurality of radial supports between the slots, such as support 703 between slot 701 and slot 702 which separates the abrasive segments 201 and 202 when they are inserted into their respective slots.

In the present embodiment, the slots are axially-oriented radial slots. They therefore have their narrowest dimension in the direction orthogonal to the axial and radial directions of the rotary dressing tool 101. The slots are dimensioned such that abrasive segments having tabs fit within them, such as first abrasive segment 201 and second abrasive segment 202.

In a specific embodiment, the hub 103 and the radial slots include channels and holes (not shown) for delivery of cooling fluid and/or lubricant to the interface of the abrading surface 102 and the grinding wheel undergoing dressing.

Referring to FIG. 7B, it may be seen that in the plane coincident with the axial and radial directions, each radial support, for example support 703, generally conforms in the present embodiment to the shape of the abrasive segments, save for the abrading edge itself. In this way, the abrasive segments are supported over a substantial portion of their surface area by the supports on the hub 103. In the present embodiment, given the dimensions of the slots and abrasive segments match, the combination of the hub and abrasive segments create a substantially solid whole around the circumference of the rotary dressing tool 101.

Thus, in use, as an abrading edge of a particular abrasive segment is drawn over a grinding wheel during a dressing operation, the friction therebetween causes a force to be exerted upon the abrasive segment in a direction opposite to the direction of rotation of the rotary dressing tool 101. This force is transmitted as a compressive load upon the adjacent support, and in turn through to the next abrasive segment, et cetera, around the circumference of the rotary dressing tool 101.

It will be appreciated that unlike in prior art rotary dressing tools, which typically have a steel hub to facilitate electroplating of diamond grits thereto, the hub 103 may be made of a material selected for light weight rather than for compatibility with the electroplating process. Thus in the present example, the hub 103 is an aluminium hub. The slots may be produced in such a hub by a process of wire electrical discharge machining. Alternatively, the hub may be made of a composite material such as a carbon-fibre reinforced plastics material to reduce weight further.

FIGS. 8A & 8B

Given the axial orientation of the radial slots in the outer circumference of the hub, the abrading edges of the abrasive segments are oriented in the axial direction. This allows the adoption, if required, of complex profile geometries for the abrading edges. In practice, the profile of the abrading edge will be particular to the geometry of the grinding wheel the rotary dressing tool 101 will dress. For example, the profile of the abrading edge may be parallel, or alternatively not parallel to with the tab 401 and thus the axis A-A. Further, the profile may follow a straight or a curved path or a combination thereof.

Figure 8A:
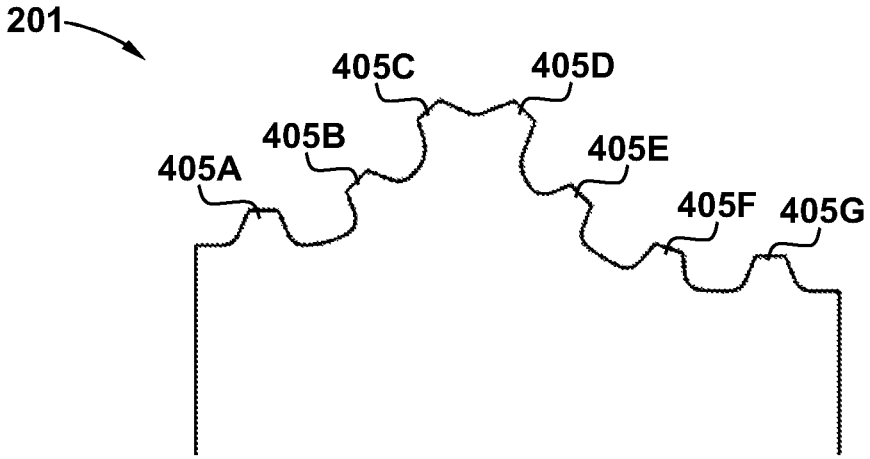
FIG. 8A identifies individual abrasive elements on the abrading edge of an abrasive segment.

A magnified view of the first abrasive segment 201 is shown in FIG. 8A, identifying each abrasive element individually. Thus the first abrasive segment 201 has abrasive elements 405A, 405B, 405C, 405D, 405E, 405F, and 405G.

Figure 8B:
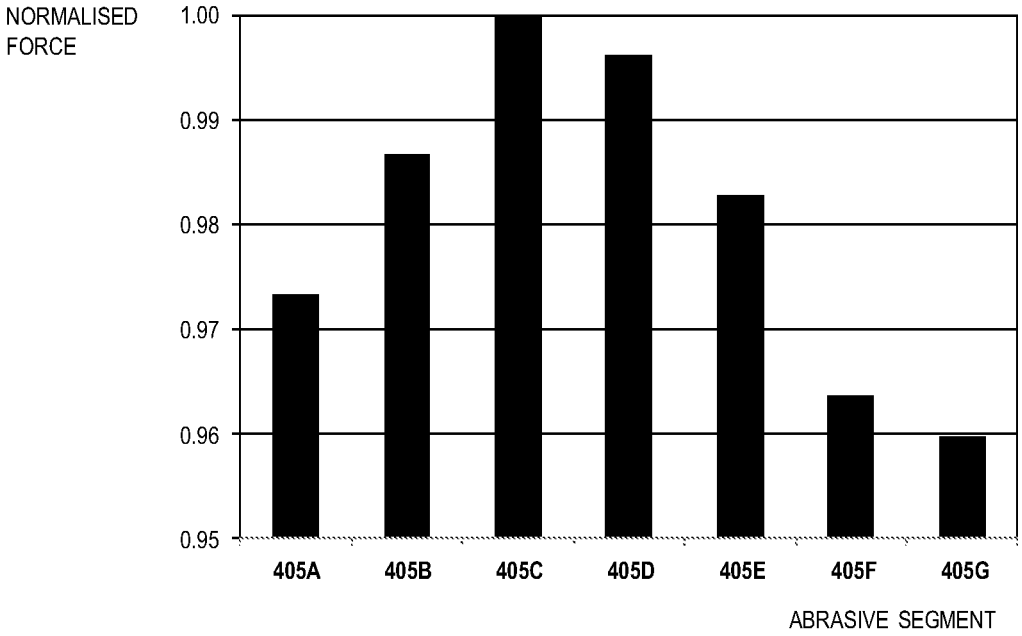
FIG. 8B shows the normalised force experienced by the abrasive elements identified in FIG. 8A.

A plot of the force experienced by each abrasive element is shown in FIG. 8B, with the abscissa identifying the particular abrasive element and the ordinate being the normalised force experienced. The greater force is due to the variation in local radius resulting in greater speed, as, for example, abrasive elements 405C and 405D are further from the axis A-A than abrasive elements 405A and 405G.

FIGS. 9A & 9B

The variation of force due to radius results in, for a fixed size of abrasive element 405, different stress conditions depending upon the distance from the tab 401.

Figure 9A:
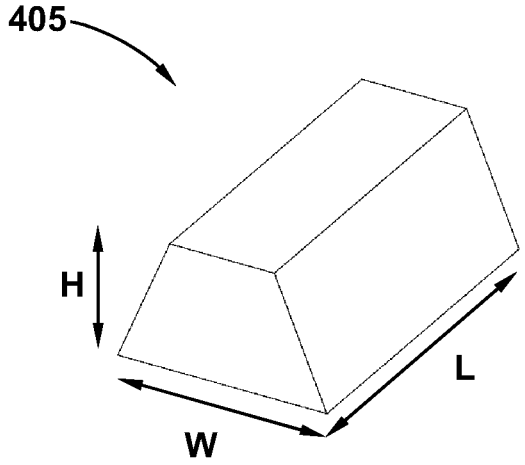
FIG. 9A identifies the dimensions of the abrasive elements.

The stress $\sigma$ experienced by an abrasive element 405 may be considered as the force F over its base area A, which, referring to FIG. 9A, is the dimension L multiplied by the dimension W, i.e. $\sigma=FA^{-1}$. In the present embodiment, the abrasive elements 405 further from the tab 401 are adapted to withstand greater stress conditions than those closer to the tab. For example, one or more of dimension L and W may be varied to achieve the same stress value for each abrasive element.

In a specific embodiment, the width W of the abrasive elements 405 is varied such that the further an abrasive element 405 is from the tab 401, the wider it is. In alternative embodiments, only the dimension L may be varied, or both the dimension W and the dimension L may be varied.

Alternatively, other measures may be taken to adapt the abrasive elements to withstand greater stress, such as a change in geometry.

Figure 9B:
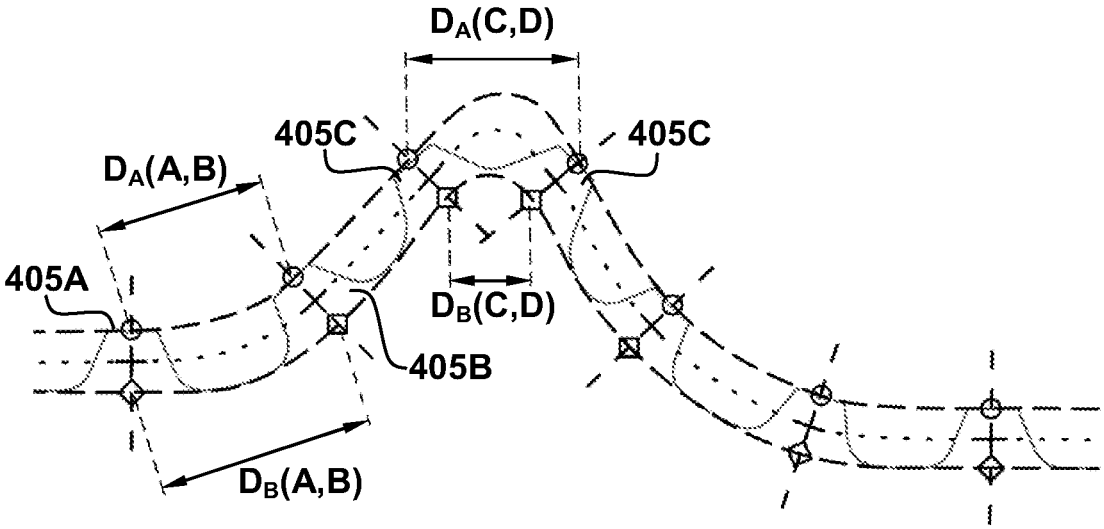
FIG. 9B identifies the variation in distances between the abrasive elements.

FIG. 9B illustrates a further measure which is employed in the present embodiment to increase wear resistance. In particular, the distance $D_A$, in this example the Euclidian distance, between the centres of the abrading surface of the abrasive elements 405 is held constant. Thus the distance $D_A$(A,B) between the centres of the abrading surface of the abrasive elements 405A and 405B is the same as the distance $D_A$(C,D) between the centres of the abrading surface of the abrasive elements 405C and 405D.

This has the result of causing the Euclidian distance $D_B$ between the bases of the abrasive elements 405 to be reduced in areas of low radius of curvature and thus higher density of abrasive elements 405. This can be seen clearly in FIG. 9B, in which the Euclidian distance $D_B$(A,B) between the centres of the bases of abrasive elements 405A and 405B is substantially larger than the distance $D_B$(C,D) between the bases of abrasive elements 405C and 405D. In this way, the wear resistance of the abrasive segments is improved.

FIG. 10

Figure 10:
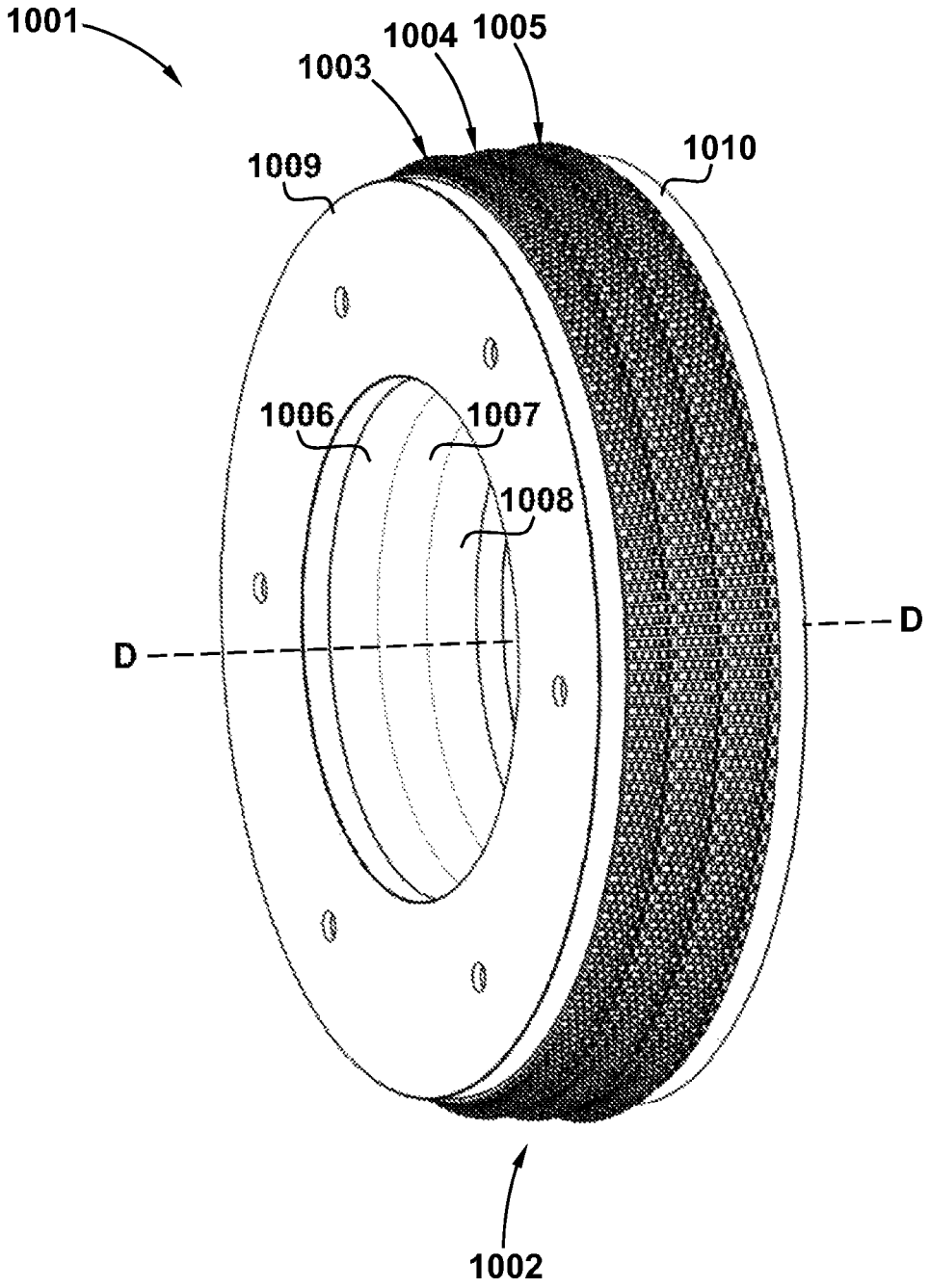
FIG. 10 shows a second embodiment of a rotary abrasive machining tool according to the present disclosure, again in the form of a rotary dressing tool.

A second embodiment of a rotary abrasive machining tool according to an aspect of the present disclosure is shown in FIG. 10. In the illustrated embodiment, the rotary abrasive machining tool is again a rotary dressing tool 1001. As discussed previously however, it will be appreciated that it could instead be configured as a grinding wheel or any other form of rotary abrasive machining tool.

Rotary dressing tool 1001, like rotary dressing tool 101, is generally annular around an axis D-D, and includes an abrading surface 1002. In this embodiment, however, the abrading surface 1002 is larger in axial extent than the abrading surface 102, and is made up of a plurality—three in this example—of axially-adjacent sets 1003, 1004, and 1005 of abrasive segments mounted on respective hubs 1006, 1007, and 1008. As with rotary dressing tool 101, two flanges 1009 and 1010 are provided to sandwich the sets of abrasive segments and the hubs.

FIGS. 11 & 12

Figure 11:
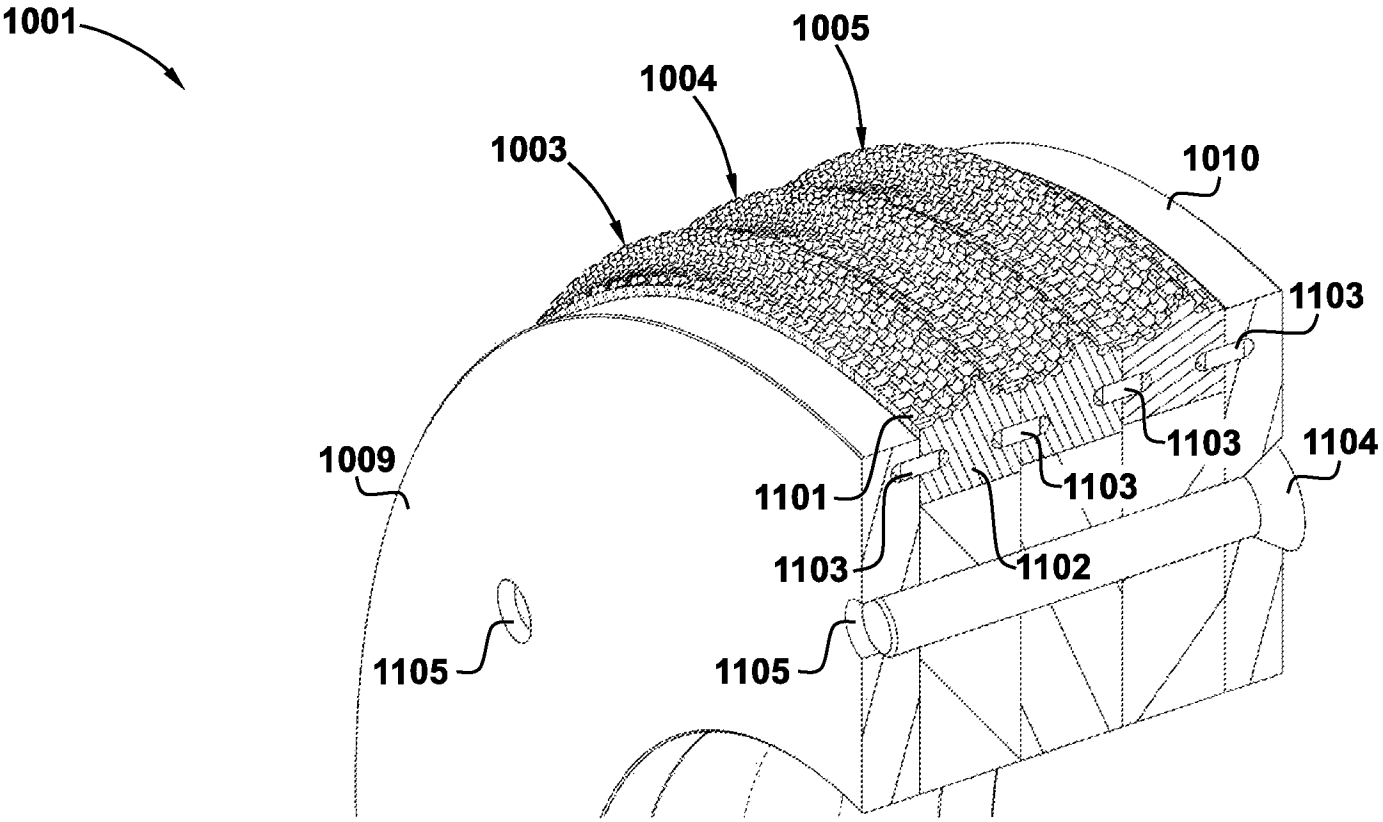
FIG. 11 shows a cutaway of the rotary dressing tool of FIG. 10.
Figure 12:
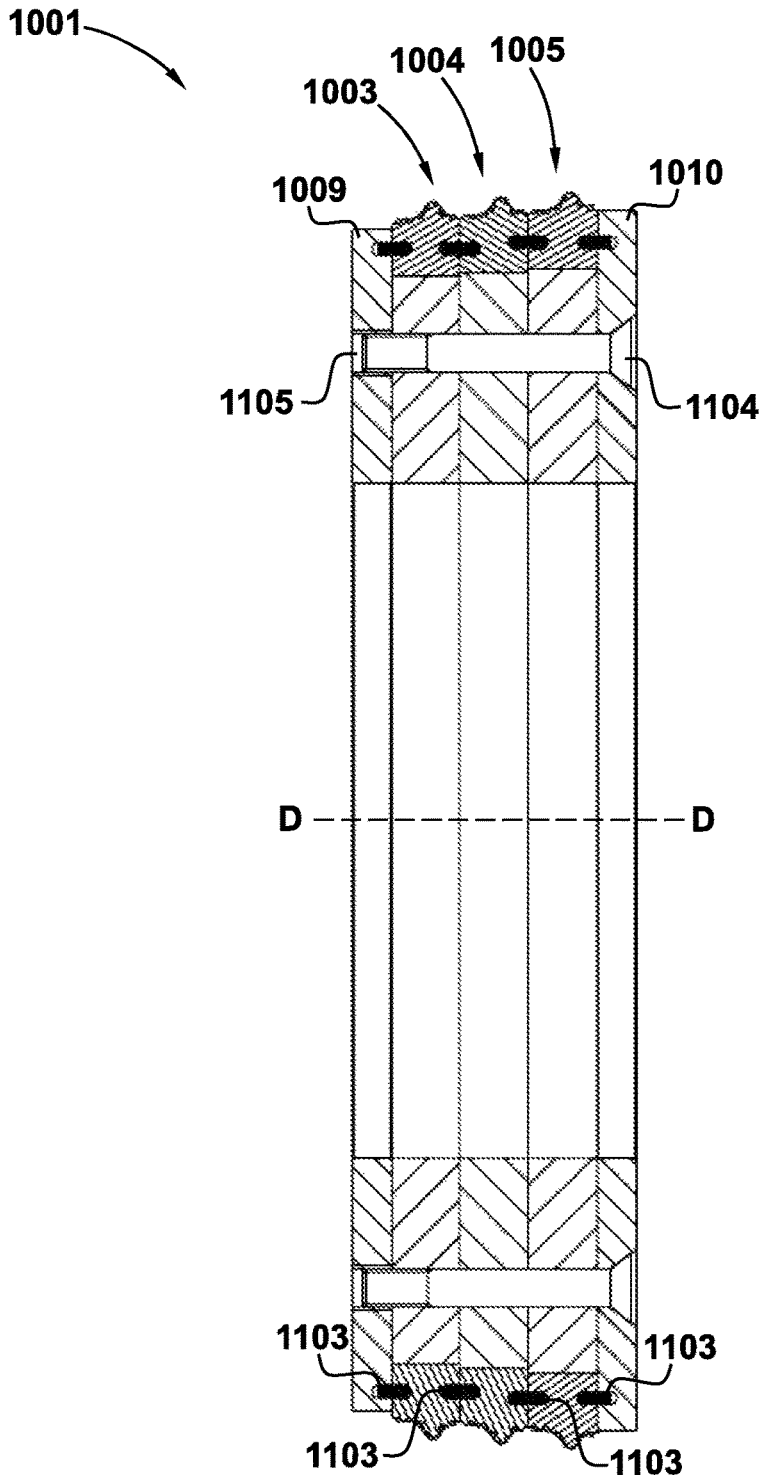
FIG. 12 shows a section along the axial-radial plane of the rotary dressing tool of FIG. 10.

A partial cutaway of the rotary dressing tool 1001 is shown in FIG. 11, and a section in the axial-radial plane is shown in FIG. 12.

In the present example, each set 1003, 1004, and 1005 of abrasive segments comprise a plurality of abrasive segments such as first abrasive segment 1101 and second abrasive segment 1102. These are substantially similar to the abrasive segments 201 and 202 of the rotary dressing tool 101, and thus in the present example, in each set, each abrasive segment has abrasive elements that are axially offset relative to the abrasive elements on the next abrasive segment around the circumference.

Each hub 1006, 1007, and 1008 is similar in configuration to the hub 103 of the rotary dressing tool 101, in that they each include a plurality of axially-oriented radial slots (not shown) in their outer circumference for receiving the abrasive segments.

The abrasive segments are retained in the hub by rings 1103. It will be seen from FIGS. 11 and 12 that the abrasive segments each include a cutout on either side in which the rings 1103 are received. The outermost rings are received in similar cutouts in the inner edges of the flanges 1009 and 1010. In this way, radial movement of the abrasive segments is prevented.

Axial movement is prevented by the flanges, which are held together by a plurality of bolts 1104 whose heads are retained in countersunk holes the flange 1010, and which thread into a threads 1105 in the flange 1009.

In the present example, the rotary dressing tool 1001 is adapted to dress a grinding wheel that will in turn grind a fir tree profile in the root of a turbine blade for a gas turbine engine. As will be appreciated, a fir tree profile comprises a plurality of flanks on opposite sides of a root, which converges towards an apex.

To facilitate generation of this profile with the minimum different types of parts, in the present example the sets 1003, 1004, and 1005 of abrasive segments are identical. The profile of the abrasive segments, is such that the height at one side is lower than at the other. Thus when placed next to each other, with the profile ends aligned, the bottom of the segments are offset. Thus, in the present embodiment, the hubs 1006, 1007, and 1008 are each of progressively greater diameter. Thus, in the present example, there is only a requirement for two types of abrasive segments to be machined from blanks.

It will be appreciated of course that the abrasive segments in each set may have different profiles, thus facilitating the dressing of grinding wheels with more complex geometry.

Finally, it will be understood that the disclosure is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. An abrasive segment for a rotary abrasive machining tool, the abrasive segment comprising:

a tab for location in an axially-oriented radial slot on the rotary abrasive machining tool; and an abrading edge defining a plurality of abrasive elements, wherein the abrasive elements further from the tab are adapted to withstand greater stress conditions than those closer to the tab.

2. The abrasive segment of claim 1, in which:

the abrading edge has a profile upon which each one of the plurality of abrasive elements lies; and each one of the plurality of abrasive elements has an abrading surface that is parallel to the profile of the abrading edge at the location of the respective abrasive element.

3. The abrasive segment of claim 1, in which each one of the plurality of abrasive elements has an abrading surface, and there is a constant distance between the centres of the abrading surfaces.

4. The abrasive segment of claim 1, in which the profile of the abrading edge is not parallel to the tab.

5. The abrasive segment of claim 1, wherein the profile of the abrading edge follows one of:

a straight path;

a curved path.

6. The abrasive segment of claim 1, in which the abrasive elements further from the tab are wider than those closer to the tab.

7. The abrasive segment of claim 1, in which the abrasive segment is one of:

cubic boron nitride;

diamond.

8. A method of producing an abrasive segment for a rotary abrasive machining tool, the abrasive segment comprising a tab for location in an axially-oriented radial slot on the rotary abrasive machining tool; and an abrading edge defining a plurality of abrasive elements, the method comprising:

obtaining a blank of material for the abrasive segment;

machining the abrasive segment from a blank, wherein the machining process is one of:

electrical discharge machining;

pulsed laser ablation;

water jet cutting.

9. A rotary abrasive machining tool comprising:

a hub having plurality of axially-oriented radial slots in the outer circumference thereof;

a plurality of abrasive segments, each one of which has a tab which is located in a respective slot in the hub, wherein (i) the abrasive elements on adjacent abrasive segments are axially offset in relation to each other, or (ii) the abrasive segments are retained in the slots by flanges attached either side of the hub.

10. The rotary abrasive machining tool of claim 9, in which the abrading edge of each one of the plurality of abrasive segments has one of:

the same profile;

one of a plurality of different profiles.

* * * * *